United States Patent [19]

Knepp et al.

[11] Patent Number: 5,020,350

[45] Date of Patent: Jun. 4, 1991

[54] APPARATUS AND METHOD FOR LUBRICATING AND COOLING IN A DRAW AND IRON PRESS

[75] Inventors: James E. Knepp, Plum Borough; Robert E. Welsh, Mount Lebanon; James A. Miller, Washington Township, Armstrong County; Raymond Miller, Lower Burrell, all of Pa.

[73] Assignee: Aluminum Company of America, Pittsburgh, Pa.

[21] Appl. No.: 368,284

[22] Filed: Jun. 19, 1989

[51] Int. Cl.[5] ..... B21D 22/20; B21D 37/16; B21D 37/18

[52] U.S. Cl. ..... 72/45; 72/347

[58] Field of Search ..... 72/41, 42, 43, 44, 45, 72/347, 348, 349

[56] References Cited

U.S. PATENT DOCUMENTS

| | | | |
|---|---|---|---|
| 3,605,473 | 9/1971 | Lyon et al. | 72/43 X |
| 3,653,249 | 4/1972 | Dunn | 72/349 |
| 3,709,012 | 1/1973 | Larsonneur | 72/43 X |
| 3,735,629 | 5/1973 | Paramonoff | 72/349 |
| 3,837,199 | 9/1974 | Larsonneur | 72/21 |
| 3,911,704 | 10/1975 | Bridenbaugh et al. | 72/42 |
| 3,923,671 | 12/1975 | Knepp | 252/49.5 |
| 4,148,208 | 4/1979 | Maeder | 72/342 |
| 4,223,544 | 9/1980 | Main | 72/45 |
| 4,243,537 | 1/1981 | Knepp et al. | 252/49.3 |
| 4,260,502 | 4/1981 | Slanker | 252/49.5 |
| 4,262,512 | 4/1981 | Maeder | 72/45 |
| 4,300,375 | 11/1981 | Maeder et al. | 72/45 |
| 4,881,394 | 11/1989 | Jansen | 72/45 |

OTHER PUBLICATIONS

"Drawing and Ironing Lubricants for Aluminum Can Drawing", The Can Division of Reynolds Metals Company, presented to Non-Ferrous Metals Council of the American Soceity of Lubrication Engineers, Apr. 18, 1978.

*Primary Examiner*—E. Michael Combs
*Attorney, Agent, or Firm*—Douglas G. Glantz

[57] ABSTRACT

The invention includes apparatus and method for lubricating and cooling a workpiece, dies or ironing rings, and punch at the interface between the workpiece and such dies or ironing rings and punch in forming a workpiece into a hollow closed end cylindrical article.

A lubricant liquid phase is injected into a coolant liquid phase to form a "dispersion" prior to application to the metal-tool interface. Providing the lubricant as a dispersion in the coolant liquid phase rather than as an emulsion provides several advantages. The quantity of lubricant and the time of lubricant injection can be varied to control lubricity and, thus, friction. The invention makes it possible to achieve differential friction in the ironing process by having higher lubricity on the ironing die (low friction) and lower lubricity on the punch surface (high friction). Lubricities and cooling are controllable for the specific metal forming process employed to produce closed end hollow body containers. After applicaiton, the lubricant and coolant are separated, the lubricant filtered to remove debris, stored, and then reinjected to provide lubrication for the process.

20 Claims, 4 Drawing Sheets

APPARATUS AND METHOD FOR LUBRICATING AND COOLING IN A DRAW AND IRON PRESS

BACKGROUND OF THE INVENTION

This invention relates to apparatus and method for drawing or for drawing and ironing a workpiece. More particularly, the invention relates to apparatus and method for lubricating and cooling a workpiece and an ironing ring or die in a press as the workpiece is worked within the ring or die.

The principal method of making can bodies for the carbonated beverage market is to draw and iron the bodies from a circular metal blank. A typical can body is made by blanking, drawing the blank into a shallow cup, and then forcing the cup directly through two or more ironing dies to thin and lengthen the sidewall. The blank is usually first drawn into a cup with a draw press, and thereafter the cup is redrawn and ironed with a redraw and ironing press, commonly referred to as a bodymaker.

In ironing the sidewall of the cup to thin and lengthen it, the metal is severely worked as it passes through at least two or more ironing rings or dies. Bodymakers operate at very high speeds to produce economically the volume of can bodies required to satisfy the market.

To minimize the amount of heat generated in the workpiece and tooling as an effect of such severe, high speed forming, and to minimize stresses in the sidewall from friction with the ironing ring, it is necessary to flood or bathe the tooling and workpiece with a lubricant and coolant. Without proper lubrication and cooling, the workpiece becomes distorted. It may fracture, or the tools may become damaged by metal pickup or metal transfer, for example, from the workpiece.

Heretofore, the workpiece and tooling have been cooled and lubricated with lubricant and coolant mixtures which include lubricants distributed to the tooling or workpiece in a variety of ways. U.S. Pats. Paramonoff 3,735,629, Maeder 4,148,208, and Main 4,223,544 are patents which disclose in whole apparatus for distributing lubricant and coolant in a drawing and ironing press. Although effective systems have been developed for lubricating bodymakers, problems still arise which affect productivity, waste disposal, cost of washing can bodies, can quality, and flavor of the packaged product.

There is a need, therefore, for improved methods and apparatus for lubricating and cooling for drawing and ironing metal articles.

SUMMARY OF THE INVENTION

The present invention includes apparatus and process incorporating lubricant "dispersed" in a coolant for application to the workpiece and the tooling employed in forming a closed end hollow body.

In accordance with the invention, a lubricant liquid phase is injected into a coolant liquid phase to form a "dispersion" prior to application to the metal-tool interface. Providing the lubricant as a dispersion in the coolant liquid phase rather than as an emulsion provides several advantages. The quantity of lubricant and the time of lubricant injection can be varied to control lubricity and, thus, friction. The invention makes it possible to achieve differential friction in the ironing process by simultaneously providing, at appropriate times, higher lubricity on the ironing die (low friction) and lower lubricity on the punch surface (high friction). Lubricities and cooling are controllable for the specific metal forming process employed to produce closed end hollow body containers. After application, the lubricant and coolant are separated, the lubricant filtered to remove debris, stored, and then reinjected to provide lubrication for the process.

It is an object of the present invention to provide a more effective and lower cost lubricating and cooling system for the workpiece and tooling while forming a closed end hollow body than a system using an emulsified lubricant.

It is another object of the present invention to provide lubricity at lower percent lubricant concentration while reducing lubricant carry-out on cans, reducing washer costs and lubricant costs, and reducing environmental waste costs.

It is another object of the present invention to provide a lubricant liquid phase maintained chemically consistent by direct analysis and makeup and having an essentially infinite batch life.

An additional object of the present invention is to provide reduced environmental problems by eliminating the need for chemical emulsifiers in the process lubricant and to permit the same process lubricant to be acceptable for lubrication of the machinery gears and hydraulic systems of the apparatus.

It is another object of the present invention to provide the apparatus to handle and maintain a dispersion lubricant and to properly apply a dispersion lubricant to the workpiece and tools of this invention.

It is another object of the present invention to provide a differential lubricity between (1) the workpiece and the ironing die and (2) the workpiece and the punch.

These and other objectives and advantages will be more apparent with reference to the following detailed description of the invention and accompanying drawings.

DETAILED DESCRIPTION

Figure 1:
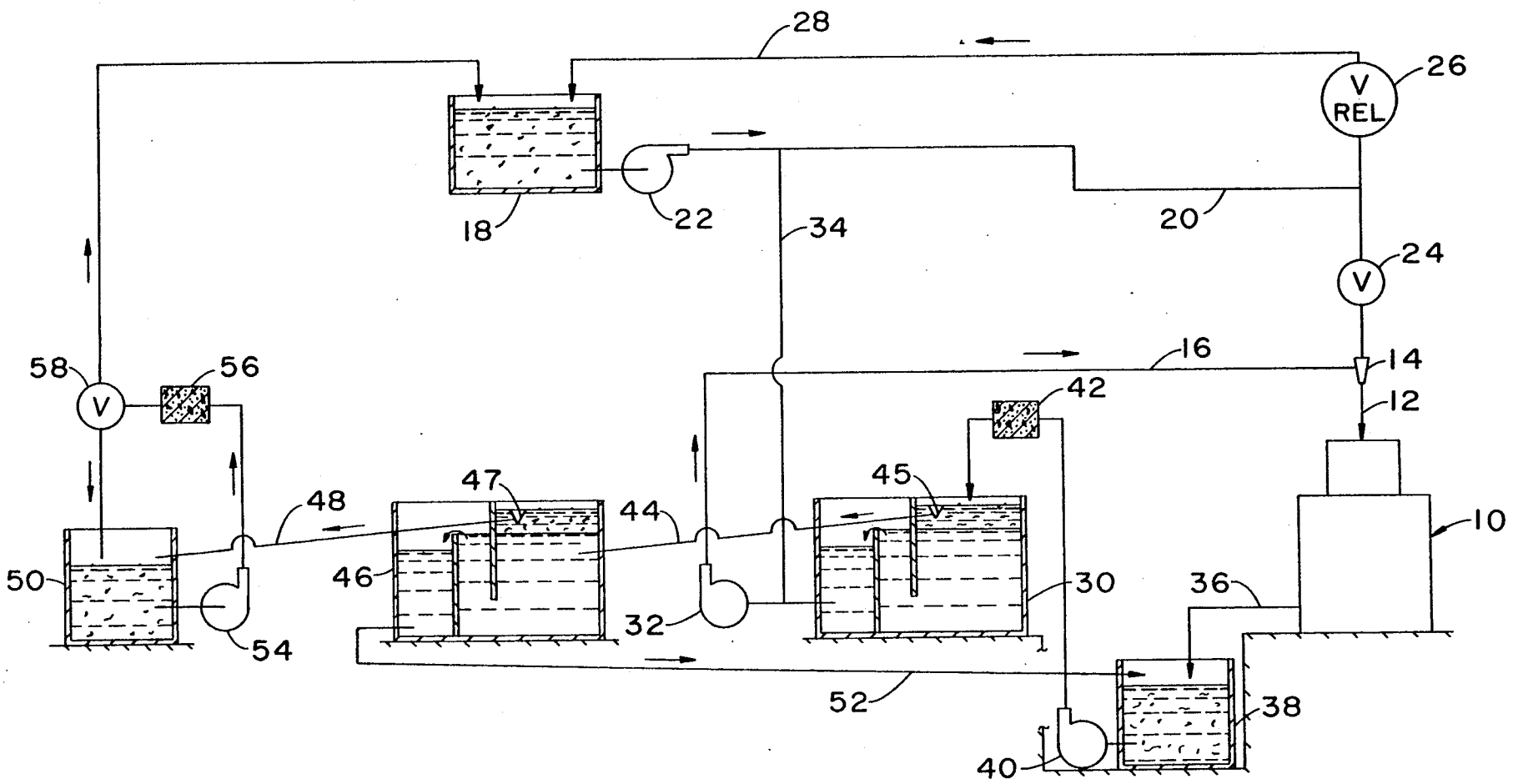
FIG. 1 is a schematic drawing of the lubricant and coolant handling apparatus of this invention.
Figure 2:
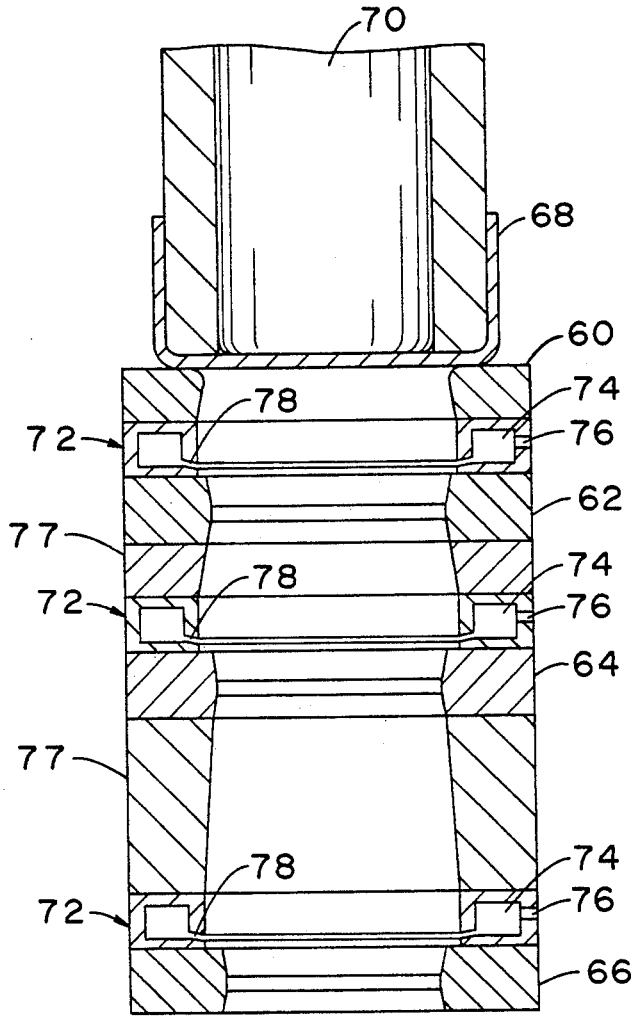
FIG. 2 is a cross-sectional view of a tool pack of a redraw and iron press portion of apparatus of this invention. It shows a cup mounted on a punch in position to work the cup through the tool pack and form a redrawn and ironed can body.

The present invention provides apparatus and method involving lubricating and cooling systems employing "dispersion" lubrication to provide unique advantages over mineral oil emulsions or synthetic oil emulsion-formulated lubricants or of soluble type synthetics.

Combining a lubricant with a coolant, such as water or a water-based coolant, as a "dispersion" different from and rather than an emulsion provides a distinctly different lubricant/coolant mixture. In forming an emulsion, surface active chemical materials known as emulsifiers produce very small droplets, i.e., droplets predominately 3 microns and smaller, of the lubricant liquid phase, and a stable or tight chemical emulsion results. To form a "dispersion" of lubricant as referred to in the present invention, the lubricant is "mechanically" dispersed in the water phase coolant, i.e., injected in the form of droplets estimated as approximately 40–50 microns in diameter by injecting it therein with an injection nozzle, such as an atomizer for example. Emulsions are characterized as being substantially chemically stable with unalterable interrelated cooling and lubricating capabilities. In contrast, the lubricant liquid phase of a dispersion of this invention is chemically formulated without emulsifiers to be unstable once mixed or mechanically sheared with the coolant. This provides for instant availability of the lubricant liquid phase at the workpiece-forming tool interface. This availability of lubricity is achieved at less concentration of the lubricant liquid phase in the coolant than with emulsions.

A dispersion provides both the cooling and lubricating requirements in the draw and iron process in unique control of either cooling or of lubricating independent of the other. Control of cooling is achieved by proper volume flow, temperature control, and consistent, uniform application. Lubricity control is achieved by providing a proper lubricant formula and modifying the hardware or systems apparatus properly to handle, filter, and reapply that lubricant liquid phase.

The lubricant liquid phase is formulated chemically to be very unstable by phase when mixed or sheared with the coolant liquid phase. This provides for very high and instant availability of the lubricant liquid phase at the workpiece-forming tool surface interface. This lubricity is achieved at notably less concentration of lubricant in the coolant than with emulsions (i.e., 0.2% to 0.6% by volume in units lubricant per unit water for the dispersion invention vs. 4.0% to 6.0% for emulsions).

Combined cooling and lubricating is achieved by injecting the lubricant liquid phase into the cooling liquid phase just prior (in distance) to its application to the metal-tool interface. By controlling the amount or timing of the injected lubricant, lubricity can be controlled and substantially instantly varied as desired. It is, thus, possible to have differential lubricity or friction on the punch surface and the ironing ring surface. This is a significant factor in ironing deformation.

The apparatus and method of the present invention provide a departure from commercial lubricant spray rings designed to distribute a continuous flow of a single liquid serving as both coolant and lubricant in ironing. The circular spray rings for lubricant and coolant application in processes such as drawing and ironing of cans typically have only one concentric ring and groove and are acceptable for application of emulsion and soluble type lubricants. These spray rings provide consistent and uniform application and distribution of the lubricant and coolant where the liquid itself is an emulsion of homogeneous solution. The emulsion provides a chemically controlled uniform distribution of oil droplets or a homogeneous soluble lubricant type such as synthetics.

The lubricant used in conjunction with the present invention is a dispersion created by spraying or injecting lubricant into the coolant flow upstream from the lubricant spray ring. Where the liquid is a dispersion of lubricant droplets and where additional lubricant is spray-injected into the coolant stream on an interrupted, timed basis, the conventional circular spray ring will not function properly. The spray-injected lubricant portion of the coolant stream must flow such that it reaches the total circular ring groove at the same precise time.

The apparatus and method of this invention incorporate two types of spray ring configurations, each type maintaining an aspect of separation of coolant liquid phase from lubricant liquid phase and a precise timed and controlled aspect when the lubrication phase is applied at the workpiece.

Lubricants and coolants used with conventional apparatus and process for forming drawn and ironed cans and similar forming processes include soluble oils (emulsions), synthetics (emulsions and fully soluble forms), and mechanical-hydraulic lubricants used to maintain the equipment. These lubricants used in many different combinations influence the total process and create known inconsistent and uncontrollable conditions. These conditions cause difficulties with metal deformation, productivity, can quality, washer efficiency, environmental waste concerns, and undesirable costs. Emulsions and soluble synthetics are formulated and maintained as chemically stable and unalterable interrelated cooling and lubricating characteristics. Lubricity will not vary nor can it be altered over short time periods.

Lubricants used in this invention are formulated without chemical emulsions and are applied to the workpiece as a mechanical dispersion in the coolant or water phase. When the lubricant formula without emulsifiers is injected into the coolant stream, it is unstable and provides instantly available lubricant liquid phase at the workpiece-forming tool interface. Supplying the lubricant as a dispersed lubricant in the coolant permits control of the quantity and time of lubricant injection, thus it is possible to control lubricity and thus friction and further to use this to achieve low friction between the workpiece and ironing die and high friction between the workpiece and the punch surface. This present invention achieves proper lubricity properties at notably less concentration of the lubricant in the coolant than with emulsion lubricants (i.e. 0.2% to 0.6% compared with 4.0% to 6.0%). Furthermore, the lubricants formulated without emulsifiers can be used as mechanical-hydraulic lubricants, thus eliminating a serious source of process contamination. Any leakage or use of these lubricants into the process-system is fully compatible with the process and consumed as a portion of normal make-up lubricant.

After application of the dispersed lubricant and coolant to the workpiece, the lubricant liquid phase is separated from the coolant liquid phase, filtered to remove metal wear debris, stored, and reinjected to the workpiece as required. The lubricant liquid phase flushes the wear debris from the workpiece, transports it to the filter for efficient removal, and, thus, is returned to the workpiece as essentially new lubricant. Surface quality of the can is notably improved in brightness and fewer defects.

At lower percentages of injected lubricant compared with emulsions, there is less lubricant carry-out on the formed cans to the washer. As the lubricant is not chemically emulsified, the lubricant liquid phase readily breaks out of the washer and the plant waste effluent, and when segregated, can be reused in the process. As the lubricant is not chemically emulsified, it can also be used as the hydraulic and mechanical machinery lubricant, thus it is not a contaminant to the system lubricant as are emulsifiers used today.

By this invention, lubricity can be substantially instantly varied and controlled as desired to achieve maximum lubrication control at precise times in the process. Furthermore, differential lubricity can be realized on the punch and on the ironing ring, which is significant for ironing deformation. Required lubricity can be achieved at lower percent lubricant concentrations, reducing carry-out on cans, washer costs, and lubricant costs. The lubricant liquid phase can be effectively filtered and maintained essentially unaltered, thereby improving can quality and reducing lubricant degradation. The lubricant liquid phase can be maintained chemically consistent by analysis and make-up, providing essentially infinite sump life. Productivity and consistency are improved through control of lubricant and lubricity factors not possible with emulsions. The lubricant formula free of emulsifiers readily breaks out in washer and plant effluent waste, reducing environment problems. The lubricant formula free of emulsifiers can be used as the machinery hydraulic and gear lubricants.

In the drawing and ironing apparatus and method of the present invention, cooling water as the coolant liquid phase with small residual quantities of the lubricant is supplied to the spray rings just in front of the ironing rings. The lubricant liquid phase is injected into the water (liquid) phase supply lines just prior to the spray ring. Lubricant is injected into the water phase through selected atomizing nozzles under differential pressures such that relatively small droplets of the lubricant are uniformly dispersed (mechanically) into the flowing water streams. Although the droplets are relatively small, they are considerably larger than those of a chemically emulsified lubricant and thus very readily available to coat the metal workpiece and tool to provide the required lubrication.

The spent water phase and lubricant liquid phases then are properly separated in an "operating tank." The lubricant liquid phase is filtered, stored, and then reinjected into the recycling water phase at levels required by the process. In this manner, the lubricant liquid phase becomes controllable and can be applied intermittently, when and where it is needed in the ironing stroke. Thus, through this control, differential levels of friction can be achieved, high on the punch and low on the ironing ring.

Control of the injected lubricant is achieved through a hydraulic type pumping system, supplying the lubricant at constant pressure and controlled flow rate to the selected atomizing nozzles, and a sophisticated control system of an encoder, fast operating valves, and electronic timing that injects the lubricant at precise positions of the ironing stroke for each spray ring. Lubricant is injected on the forward stroke at precise times and is not injected at all or at very low levels on the punch surface on the return stroke.

A first type spray ring configuration for providing the controlled delivery (shown in FIG. 4) has two manifold cavities and two distribution grooves in the same ring. The two circular manifolds would be of similar dimensions. They are interchangeable in application of coolant and dispersed lubricant to the workpiece. This spray ring design for separate flows of coolant and dispersed lubricant provides independent, uniform, and controllable application. This is achieved by a separate supply port, manifold, and spray groove or passageway holes for each flow. This spray ring design provides for one manifold to apply a continuous flow of coolant having a very dilute or minimal amount of lubricant (0.2% to 0.6%) in the water-based coolant flow. The second manifold applies the dispersed lubricant liquid phase.

The dispersed lubricant liquid phase is composed of a controlled flow portion of the normal coolant supply into which the lubricant is injected under differential pressure (50 to 200 psi) via an injection spray nozzle. This dispersed lubricant liquid phase is typically 0.5% to 0.75% by volume concentration.

The dispersed lubricant liquid phase is controlled in its application by a control valve located downstream from the lubricant injection spray nozzle and prior to the inlet of the second spray ring manifold. This control valve on each of the inlets to the two or three rings is individually synchronized to open and close at precise times to apply the dispersed lubricant liquid phase to the ironing dies on the forward ironing stroke and to withhold or reduce the application to the punch on the return stroke, thus achieving low and high friction on the ironing die and punch respectively.

Figure 5:
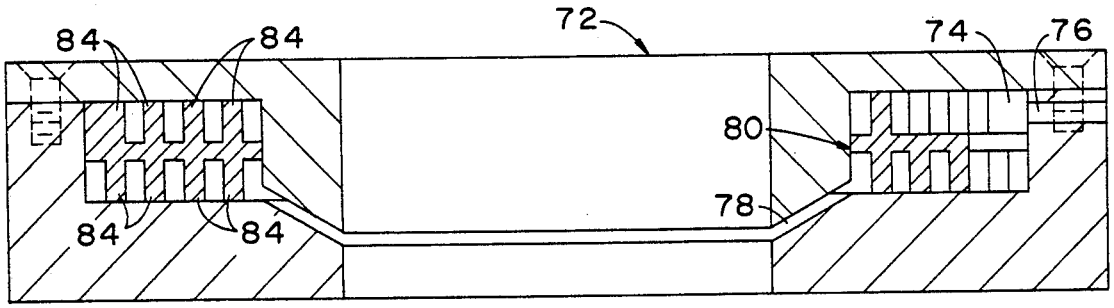
FIG. 5 is a cross-sectional view of an additional embodiment of a lubricating and cooling application ring portion of apparatus of this invention.
Figure 6:
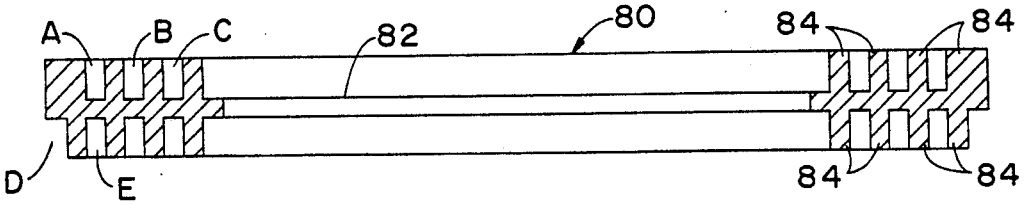
FIG. 6 is a cross-sectional view of an insert portion of the lubricating and cooling ring shown in FIG. 5.

A second spray ring configuration (shown in FIG. 5) has a single manifold cavity, distribution groove, and a unique distribution manifold insert. This unique manifold and insert provides identical flow length paths through multiple ports leading to the application distribution groove.

Figure 7:
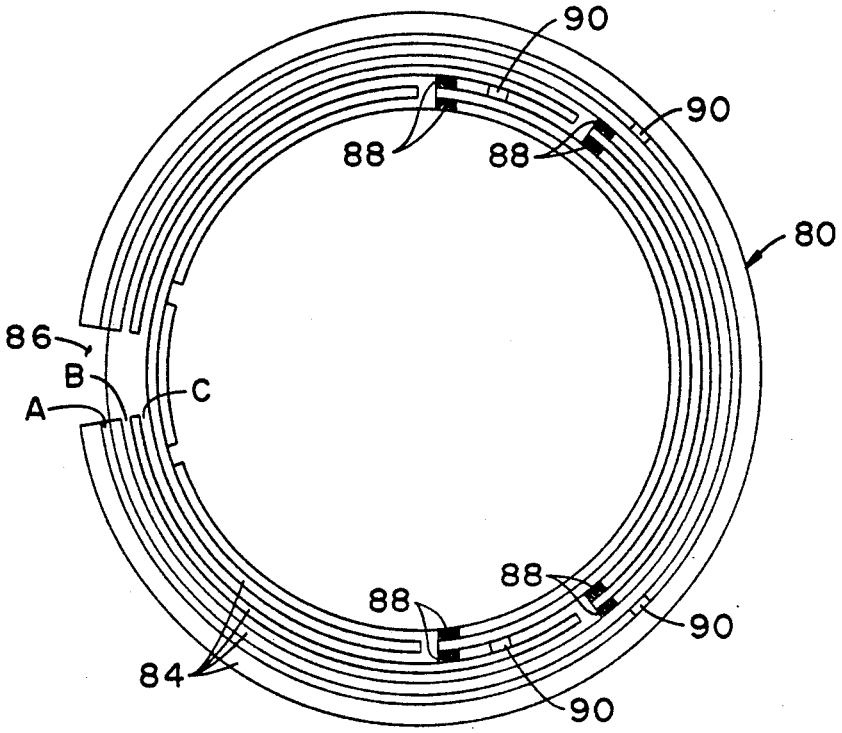
FIG. 7 is a top plan view of the insert shown in FIG. 6.
Figure 8:
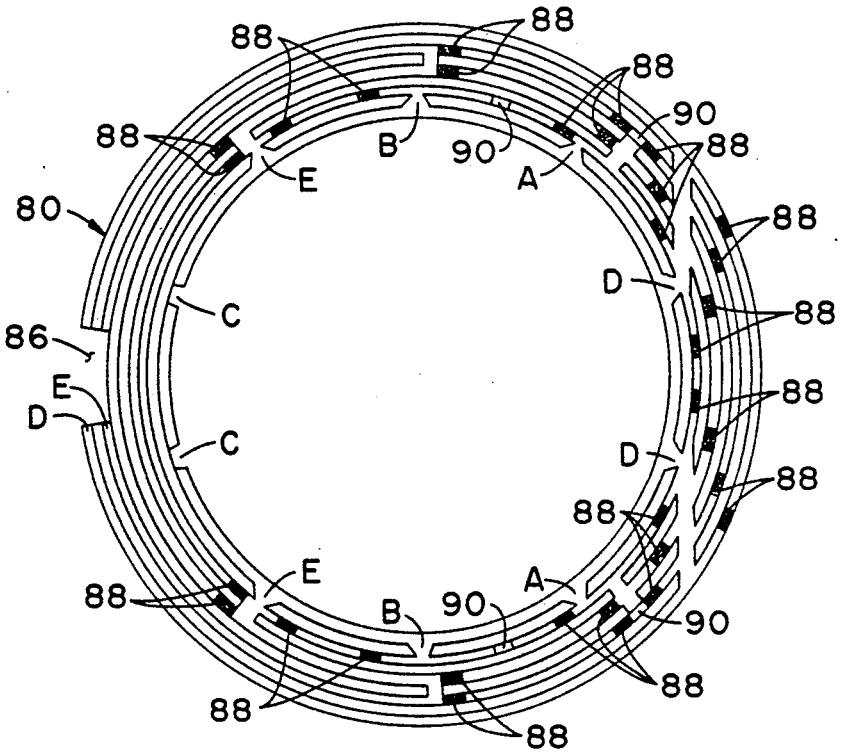
FIG. 8 is a bottom plan view of the insert shown in FIGS. 6 and 7.

Identical length of flow paths for each of ten (10) ports as shown in FIGS. 7 and 8 are achieved by a series of adjustable unique small insert dams and drilled cross access passageways to lead the flow from one insert groove to the next unit until it emerges at one of the ten ports. The flow path length is determined or adjusted by placement of the dams and drilled holes. In this invention, the coolant liquid phase would have a minimal amount of lubricant (0.2% to 0.6%) and would have continuous identical flow volume being applied on the ironing rings or dies on the forward ironing stroke and applied on the punch on the return stroke. In this invention, the lubricant liquid phase is injected into the coolant liquid phase under differential pressure (50–200 psi) to atomize the lubricant into fine droplets dispersed in the coolant liquid phase just prior to the inlet of the spray ring manifold.

With a control scheme on the lubricant liquid phase line consisting of a fast operating control valve, an encoder to identify position of the ram, and electronic timing, the lubricant can be injected at precise positions of the ironing stroke to supply dispersed lubricant on the forward stroke and stop dispersed lubricant on the return stroke. This unique distribution injection apparatus of this invention provides controlled and precise time sequence, flow path length, and uniform application from the circular spray ring of a lubricant phase injected into the coolant liquid phase being applied to the spray ring.

Minimum lubricant quantity is used to provide the required lubricity, leaving little tramp or waste residual lubricant on the formed can. Washer chemicals are reduced, the dispersed lubricant is recycled within the plant, and environmental waste concerns are reduced.

The advantages provided by the apparatus and process of the present invention include a controllable dispersed lubricant, injected on precise intermittent times and where required, including differential levels of friction on the punch and ironing ring. The controllable aspects of invention also reduce washer chemicals and reduce environmental waste problems.

A preferred embodiment of the subject invention will be described with respect to use and application on a bodymaker to make drawn and ironed can bodies. It will be apparent from the following description of the invention that it may be advantageous for use in making any closed end bodies which require drawing and ironing and which may be accompanied by high heat generation or high production rates.

Referring to FIG. 1, a bodymaker or ironing press 10 has a supply line 12 connecting thereto for delivering a lubricant liquid phase dispersed in a coolant hereinafter referred to as a dispersion. Details for applying the dispersion to the interface of the punch-workpiece and dies are presented hereinbelow. Adjacent to the press 10, an injection nozzle 14 is attached to a coolant-water supply line 16 for injecting lubricant into the coolant-water line. Although the use of the nozzle 14 for injecting lubricant is shown prior to the press 10, it will be appreciated from the preferred embodiments discussed below that the lubricant may be injected into the coolant water supply as late as ejection of each from independent and distinct channels in a lubricating and cooling ring. The lubricant is fed from a lubricant storage tank 18 through a lubricant supply line 20 with a suitable lubricant pump 22. A lubricant control valve 24 ahead of the injector nozzle 14 is provided to enable varying the quantity and timing of the supply of lubricant into the coolant. A pressure relief valve 26 and return line 28 to the lubricant tank 18 are provided for supplying a constant pressure of lubricant and to guard against an excessive lubricant line pressure. The coolant-water supplied to the bodymaker through supply line 16 is contained in a coolant tank 30 and pumped (recycled) therefrom with a suitable coolant pump 32. The coolant is preferably maintained at a constant temperature based on the physical dimension of the punch and the ironing ring. A makeup lubricant line 34 between the lubricant supply line 20 and the suction side of the coolant-water pump 32 is provided to permit maintenance of certain minimal residual lubricant concentration in the recycling coolant-water system. A discharge line 36 from the bodymaker 10 to a sump 38 carries the used dispersion away from the bodymaker after it has passed therethrough. From the sump 38, the dispersion which may now contain foreign debris from the metalworking process is pumped by a sump pump 40 through a lubricant-coolant filter 42 into the coolant tank 30.

The coolant tank 30 is partitioned into two spaces; one to contain the used incoming dispersed lubricant, and the other to contain essentially the coolant-water liquid free of the injected lubricant. A skim trough 45 in the incoming dispersed lubricant space collects a predominantly lubricant fraction from the surface which has separated from the coolant and risen to the top. This predominantly lubricant fraction is drained off through a line 44 to a lubricant-coolant separator tank 46. This tank, like the coolant tank 30, is provided with a skim trough 47 to collect a top fraction of lubricant which is essentially free of the coolant-water phase. This fraction is piped off through line 48 to a lubricant filter tank 50. Another line 52 drains the separated coolant-water phase back to the sump 38 for recirculation.

The lubricant from the lubricant filter tank is pumped by a lubricant filter pump 54 through a lubricant filter 56 to remove the extraneous particulate matter in the lubricant, and it is then passed on to the lubricant storage tank 18 for reuse as the lubricant liquid phase through the system. A valve 58 in the line leading back to the lubricant storage tank 18 from the lubricant filter 56 is controlled by a float in the lubricant storage tank to provide an automatic lubricant flow control.

The coolant used in this invention is typically water. However, the coolant may have certain minimal residual lubricant concentration to facilitate equipment protection from corrosion and provide a base level of lubrication. The lubricant used would depend at least in part on the application. For drawing and ironing, lubricants such as aqueous based formulations of mineral oil or aqueous based formulations of synthetic oil are used. An example of a lubricant suitable for the apparatus and process of the present invention includes formula modifications to the lubricant disclosed in the Knepp U.S. Pat. No. 3,923,671. Preferably, the lubricant is formulated without emulsifiers to be very unstable once mixed or sheared with the water phase. This provides for very high and instant availability of the lubricant liquid phase at the workpiece-metal surface interface. One of the advantages of using a dispersed lubricant type is that the desired lubricity can be obtained with much lower lubricant concentrations than when using emulsions. A typical lubricant injected concentration in a dispersion of this invention would be 0.2% to 0.6% by volume, for example, versus 4.0% to 6.0% by volume when emulsions are used.

A typical lubricant formula found successful in this invention is compared to the emulsifiable lubricant cited in U.S. Pat. No. 3,923,671.

| Dispersible Lubricant | | Emulsifiable Lubricant | |
|---|---|---|---|
| 5.0 Parts | Isostearic Acid | 5 Parts | Oleic Acid |
| 15.0 Parts | Triethylene Glycol Caprate-Caprylate | 15 Parts | Triethylene Glycol Caprate-Caprylate |
| 27.3 Parts | 1650 SUS Mineral Oil | 4 Parts | Polyoxyethylene Lauryl Ether |
| 51.5 Parts | 2000 SUS Mineral Oil | 4 Parts | Polyoxyethylene Stearate |
| 1.2 Parts | Corrosion Inhibitors and Antioxidants | 72 Parts | 1400 SUS Mineral Oil |

Also used successfully for stability control with this typical lubricant formula was an emulsion breaker having the trade name Nalco 6780.

A formula of synthetic base and additives which has shown successful lubrication characteristics is:

| | |
|---|---|
| 2.0 | Parts - Isostearic Acid |
| 30.0 | Parts - Butoxyethoxy Ethyl Stearate |
| 6.7 | Parts - Poly Alpha Olefin - 80 |
| 60.2 | Parts - Poly Alpha Olefin - 400 |
| 1.1 | Parts - Corrosion Inhibitors and Antioxidants |

Figure 3:
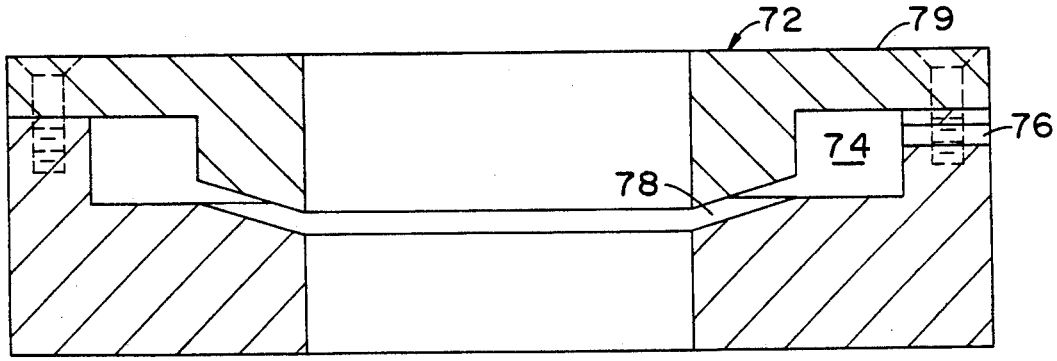
FIG. 3 is a cross-sectional view of an embodiment of a lubricating and cooling application ring portion of apparatus of this invention.

The application of a dispersed lubricant will now be discussed with reference to FIGS. 2–8. A redraw and iron press or bodymaker for making a standard 12-oz. can will typically have a redraw die 60 and three ironing rings 62, 64, 66 downstream in the direction of draw from the die and in coaxial alignment. A can body is produced by positioning a drawn cup 68 on the redraw die 60 and forcing it sequentially through the redraw die and ironing rings 62, 64, 66 with the punch 70. Each ironing ring has a slightly smaller inside diameter than the one preceding it so that as the workpiece passes through each ring, its sidewall is further thinned (ironed) and further elongated. Bodymakers in a modern can making facility produce can bodies at speeds of up to 300 bodies per minute. Considering the high rate of speed, the severity of the draw, and the substantial reduction in thickness of the wall in making a can body, lubricating and cooling of the workpiece and tooling are critical elements in producing can bodies. To provide the lubricant and coolant, a spray ring 72 is positioned immediately ahead of each ironing ring. Each spray ring 72 has an annular manifold 74 and an inlet 76 extending therefrom for attachment to the dispersed lubricant line 12. Equally spaced passageways 78 angle downwardly from the annular manifold 74 to the inside of the ring to forcibly spray the lubricant-coolant downwardly toward the ironing ring below. The passageway 78 can also be a continuous slot opening to the inside of the ring in a continuous slot. As shown in FIG. 3, the manifold 74 can be conveniently provided as a groove in the ring which is then closed with a cover 79 attached to the ring with machine screws.

To prevent a workpiece from entering an ironing ring before exiting the immediately preceding ring, spacer rings 77 of a length suitable to compensate for the increase in length of the workpiece sidewall are placed between successive lubricating and ironing rings.

As shown in FIG. 1, the lubricant liquid phase is injected into the coolant liquid phase with injection nozzle 14. Preferably, an injection nozzle is supplied for each spray ring and the point of injection is as close to the spray rings' inlet as possible. The lubricant is injected into the coolant stream under controlled pressure through an atomizing nozzle to provide many small lubricant droplets which are dispersed in the flowing coolant-water stream. Even though the droplets are very small in size, they are considerably larger than those of a chemically emulsified lubricant and thus are readily available to coat the metal workpiece and tool to provide the required lubrication.

Use of a mechanically dispersed lubricant liquid phase affords an additional benefit over a chemically emulsified lubricant in that it can be controlled for application as needed. Lubrication is desired between the workpiece and ironing rings to provide low frictional resistance between them. Only minimal lubrication between the punch and workpiece is preferred, however, because controlled higher friction between them is advantageous in reducing the stress in the sidewall of the workpiece during ironing. Thus, by using a hydraulic-type pumping system to supply the lubricant at a constant pressure and flow rate to the nozzles, an encoder, a control system of fast operating valves, and electronic timing, and the lubricant can be injected for application at precise positions of the ironing stroke for each spray ring. With a known flow rate, production rate, and travel time of the lubricant between the nozzle and spray ring, the injection nozzle and operating valves can be controlled to inject the lubricant into the coolant in such amounts and at such times that lubricant is provided primarily when the workpiece is in contact with the ironing ring. Importantly, injected lubricant in amounts from none to very little is applied to the punch on its return through the tooling after a can body has been formed and stripped therefrom.

Figure 4:
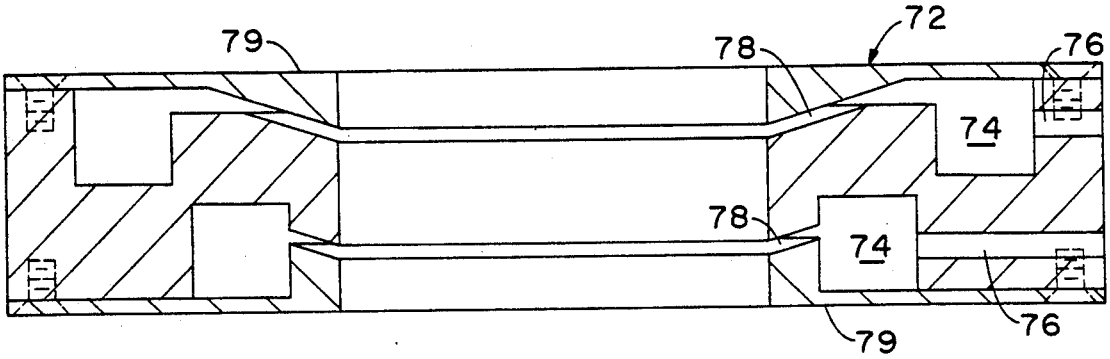
FIG. 4 is a cross-sectional view of an embodiment of a lubricating and cooling application ring portion of apparatus of this invention.

An embodiment of a spray ring suitable for use in this invention is shown in FIG. 4. In this spray ring 72, two annular manifolds 74, 74 are provided rather than one, with one of the manifolds carrying coolant-water and the other a dispersed lubricant. In using this ring, the coolant-water supply line 16 (shown in FIG. 1) feeds directly to an inlet 76 on one of the manifolds in each of the ironing rings; in this configuration the injection nozzle 14 used to inject lubricant into the coolant-water line is eliminated. Thus, one of the manifolds carries a liquid which is predominantly coolant-water and it is sprayed continuously for both the forward and return stroke while the press is being operated. As has been noted earlier, the coolant-water contains a relatively small fraction of minimal residual lubricant for the purpose of lubrication between the punch and workpiece interface and minimal lubrication and corrosion protection for pumps and machinery parts.

The second manifold in FIG. 4 is used exclusively for distributing and applying the dispersed lubricant. It may be seen that when the lubricant manifold is full, the dispersed lubricant is uniformly distributed around the ring. With no pressure on the dispersed lubricant line, no liquid is sprayed into the ring interior. As the workpiece approaches an ironing ring, an instantly sharp increase in pressure generates a uniform spray of dispersed lubricant around the ring which is sustained until the workpiece exits the ring. A dispersed lubricant control valve 24 (as shown in FIG. 1) is located on the dispersed lubricant line downstream from the point of lubricant injection and prior to the spray ring inlet 76. The dispersed lubricant control valve for each spray ring is individually synchronized by an encoder and electrical signal to open and close at precise controlled times to apply dispersed lubricant on the forward ironing stroke and to withhold dispersed lubricant to the punch surface on the return stroke, thus achieving low and high friction on the ironing die and punch respectively.

Although the purpose of providing two manifolds is to separate the application of the coolant liquid phase and the dispersed lubricant liquid phase, the lubricant liquid phase is typically not a straight (neat) lubricant. Because the most effective amount of lubricant required by volume with respect to the coolant is so small, it would be impractical if not impossible to provide it uniformly and at the proper times as a straight lubricant. The lubricant fed to the manifold, therefore, is a dispersion in a relatively high concentration in water. The water is most conveniently available by taking a controlled portion of the coolant-water supply from line 16. Thus, a line of appropriate size is attached to the coolant-water supply line and connected to the appropriate lubricant manifold inlet. An injection nozzle is attached to the lubricant supply line 20, and the lubricant is injected into this coolant-water line in small droplets for transport to the spray ring. In this case, the coolant-water is provided primarily for the purpose of carrying the injected lubricant and to facilitate its application. Typically, the lubricant concentration in the coolant-water being supplied to the dispersed lubricant manifold is 0.5% to 0.75%.

Another embodiment of a spray ring suitable for use in this invention will be described with reference to FIGS. 5, 6, 7 and 8. In this embodiment, the ring 72 is like that shown in FIG. 3 and could also be like that of FIG. 4 but where only one of the annular manifolds would be used. It is a hollow cylinder having an annular manifold 74 therein. As in the previously described embodiment, the manifold can be provided as a groove in the ring which is closed with a cover 79. An annular passageway 78 extends from the manifold 74 to an annular slot in the interior of the ring. An inlet 76 to the manifold is adapted for connection to a line carrying a lubricant-coolant mixture. An insert 80 in the manifold provides multiple channels for transporting the lubricant dispersion on substantially equal length circuitous paths to the interior outlet slot so that the timed mixture coming from any of the multiple equal length paths is distributed uniformly around the ring interior. The insert 80 has a central disc 82 with multiple annular flanges 84 projecting away from each side. It can be seen that with the insert 80 positioned in the manifold, the flanges 84 and central disc 82 define concentric grooves or channels above and below the disc. At the position on the insert at the inlet 76 to the manifold 74, a notch 86 is cut out of the disc 82 to allow incoming dispersed lubricant access to the two outermost channels (or which by design is the appropriate liquid path) below the disc. With reference to FIG. 7, it may be seen that a portion of the flanges 84 are cut away (or drilled) to provide the dispersed lubricant access to the channels above the disc. At selected points, plugs 88 are inserted to act as dams in the top channels to stop the flow of dispersed lubricant along that channel, and at other selected points the flanges are cut away to allow passage of the dispersed lubricant therethrough. Openings 90 through the disc 82 are provided in the top channels to transfer the dispersed lubricant flow from the upper part of the manifold to the lower portion. By proper location of the plugs 88, openings 90 and passages through the flanges 84, each of the dispersed lubricant flow paths designated by letters A, B, C, D, and E are the same length from the inlet 76 to the outlets and the dispersed lubricant will be timely distributed uniformly around the periphery of the ring. Lubricant control and timely application with this spray ring is achieved by continuous flow of the coolant-water phase through supply line 16. The lubricant is supplied through line 20, lubricant control valves 24, and injection nozzles 14. Lubricant injection into each spray ring inlet is individually synchronized by an encoder and electrical signal to open and close at precise controlled times to inject lubricant on the forward ironing stroke only and to have substantially no injected lubricant on the return stroke. The mixture distributed through this ring can be a dispersion of injected lubricant in water in a range of total lubricant 0.5% to 0.75% on the forward ironing stroke and a range of 0.2% to 0.6% total lubricant on the return stroke when injected lubricant is not present.

While the invention has been described in terms of preferred embodiments, the claims appended hereto are intended to encompass all embodiments which fall within the spirit of the invention.

What is claimed is:

1. Apparatus for drawing and ironing aluminum to make a closed end hollow aluminum body of acceptable surface quality comprising:

(a) at least one ironing ring;

(b) a punch adapted for reciprocal motion in coaxial alignment with said ironing ring to drawn and iron an aluminum workpiece through said ironing ring to form a closed end hollow aluminum body;

(c) a lubricating and cooling ring adjacent said ironing ring provided with channels for receiving, circulating, and discharging a lubricant or a coolant into the ring at an interior location, respectively, to lubricate or cool the ironing ring and said workpiece being forced therethrough;

(d) a coolant supply line leading to said lubricating and cooling ring;

(e) means for mechanically dispersing lubricant in coolant to make a lubricant dispersion;

(f) a lubricant dispersion supply line leading to said lubricating and cooling ring; and (g) means for injecting said coolant through said coolant supply line to said lubricating and cooling ring controllably intermittently with said lubricant dispersion through said lubricant dispersion supply line to said lubricating and cooling ring to form a uniform application of lubricant dispersion on said aluminum body and to vary lubricity at selected times during a working cycle of drawing and ironing.

2. Apparatus as set forth in claim 1 wherein said means for injecting said coolant controllably intermittently with said lubricant dispersion has at least one receiving channel ring inlet to the lubricating and cooling ring from the lubricant dispersion supply line and a plurality of said circulating channel passageways of substantially equal length extending from said lubricant dispersion supply line to a plurality of discharging channel ring outlets spaced angularly apart around the interior of the ring to form said uniform application of lubricant dispersion on said aluminum body.

3. Apparatus as set forth in claim 1 wherein said means for injecting said coolant controllably intermittently with said lubricant comprises first annular manifold means for applying said coolant and second annular manifold means for applying said lubricant dispersion, each annular manifold means having a ring inlet and independent spaced channels extending from the manifold to one or more ring outlets in the interior of the ring.

4. Apparatus as set forth in claim 1 wherein the means for mechanically dispersing lubricant comprises an injection nozzle in said dispersion supply line located upstream from the cooling ring.

5. Apparatus as set forth in claim 1 which includes means for controlling supply of lubricant dispersion to said closed end hollow aluminum body to form said uniform application in accordance with movement of the punch, such that more lubricant is fed during forward stroke than on return stroke.

6. Apparatus as set forth in claim 5 comprising two or more ironing rings disposed to contact said workpiece only one said ironing ring at a time and a reservoir for coolant and a reservoir for lubricant.

7. Apparatus as set forth in claim 6 which includes means for collecting and filtering the lubricant dispersion after it has lubricated and cooled the ring and means for separating the lubricant from the coolant after filtering the dispersion, means for transporting the filtered lubricant to a lubricant reservoir, and means for transporting the filtered coolant to a coolant reservoir.

8. Apparatus as set forth in claim 7 wherein the means for controlling the supply of lubricant includes a means for detecting the location of the punch with reference to the lubricating and cooling ring as the punch moves reciprocally, a valve for allowing or stopping the flow of lubricant to the nozzle, a means for operating the valve, and means for sending signals from the punch detecting means to the valve operating means to operate the valve according to such signal.

9. A method of lubricating and cooling an ironing die, punch, and aluminum workpiece to form a closed end hollow aluminum body in a draw and iron press comprising:

(a) dispersing a lubricant in a coolant to make a dispersion; and (b) during drawing and ironing of said aluminum workpiece contacting the die, punch, and aluminum workpiece with the dispersion controllably intermittently with additional coolant in a manner to form a uniform application of dispersion on said aluminum workpiece and to vary lubricity at selected times during a working cycle of drawing and ironing.

10. A method as set forth in claim 9 wherein said dispersing comprises mechanically injecting said lubricant in said coolant to form a dispersion of unstable liquid phase.

11. A method as set forth in claim 10 further comprising:

(c) separating said unstable liquid phases to form lubricant substantially free of said coolant.

12. A method as set forth in claim 11 wherein said dispersing includes injecting variable amounts of lubricant into coolant.

13. A method as set forth in claim 12 further comprising controlling said injecting at different times or lubricant amounts to provide a friction between a workpiece and ironing die lower than a friction between the workpiece and punch surface.

14. A method as set forth in claim 13 further comprising controlling said injecting at predetermined intervals to discharge the dispersion into a lubricating and cooling ring interior at a predetermined time.

15. A method as set forth in claim 14 whereby the predetermined time when the dispersion is discharged into the lubricating and cooling ring interior is from the time of entry of the workpiece into the interior of the lubricant ring until exit of the workpiece therefrom.

16. A method as set forth in claim 14 whereby contacting with the dispersion controllably intermittently with said additional coolant to form a uniform application of dispersion on said aluminum workpiece comprises passing said dispersion through a hollow cylindrical lubricating and cooling ring having an annular manifold therein and an inlet thereto for receiving said dispersion from a dispersion supply lie and further comprises discharging the dispersion into the lubricating ring interior through spaced apart passageways leading from the manifold.

17. A method as set forth in claim 16 whereby the lubricating ring includes a second annular manifold independent from the first annular manifold having independent passageways to the lubricating ring interior and the method includes receiving a liquid which is substantially coolant in such second manifold and discharging it through the passageways into the lubricating ring interior.

18. A method as set forth in claim 16 whereby the manifold is divided into channels of substantially equal length from the supply line inlet to spaced apart points of discharge in the ring interior and the method includes distributing the received dispersion in such channels such that each dispersion is uniformly discharged around the ring interior.

19. A method as set forth in claim 18 which includes dispersing the lubricant in an amount sufficient to make a dispersion having a dispersed lubricant content by volume of 0.2% to 0.6% at droplet sizes in the range of 40–50 microns in diameter.

20. A method of lubricating and cooling an ironing die, punch, and workpiece in a draw and iron press comprising:

(a) dispersing a lubricant of mineral oil or synthetic oil by injecting said lubricant into a coolant of water to form an unstable mechanical dispersion of lubricant-coolant in at least two lubricating streams;

(b) controlling the lubricant content in said lubricant-coolant to provide variable lubricities in the different lubricating streams;

(c) applying a first injected lubricating stream to said ironing die and workpiece on the forward stroke;

(d) applying a second lubricating stream to said punch on the return stroke such that said first lubricating stream provides a surface friction lower than said second stream; and (e) collecting lubricant from said first and second streams in a common lubricant reservoir substantially free from said coolant.

* * * * *

UNITED STATES PATENT AND TRADEMARK OFFICE

CERTIFICATE OF CORRECTION

PATENT NO. : 5,020,350

DATED : June 4, 1991

INVENTOR(S) : James E. Knepp et al

It is certified that error appears in the above-identified patent and that said Letters Patent is hereby corrected as shown below:

Claim 16, Col. 14, line 3 — Change "lie" to --line--.

Signed and Sealed this

Twenty-second Day of September, 1992

*Attest:*

DOUGLAS B. COMER

*Attesting Officer*

*Acting Commissioner of Patents and Trademarks*